US009435327B2

(12) United States Patent
Hatta et al.

(10) Patent No.: US 9,435,327 B2
(45) Date of Patent: Sep. 6, 2016

(54) SHOE

(75) Inventors: Masaharu Hatta, Toyota (JP); Satoshi Nomura, Toyota (JP)

(73) Assignee: TAIHO KOGYO CO., LTD., Toyota-shi, Aichi (JP)

( * ) Notice: Subject to any disclaimer, the term of this patent is extended or adjusted under 35 U.S.C. 154(b) by 688 days.

(21) Appl. No.: 12/735,670

(22) PCT Filed: Dec. 7, 2009

(86) PCT No.: PCT/JP2009/070464
§ 371 (c)(1),
(2), (4) Date: Aug. 5, 2010

(87) PCT Pub. No.: WO2010/137194
PCT Pub. Date: Dec. 2, 2010

(65) Prior Publication Data

US 2011/0107908 A1 May 12, 2011

(30) Foreign Application Priority Data

May 28, 2009 (JP) ..... 2009-129223

(51) Int. Cl.
*F04B 27/08* (2006.01)

(52) U.S. Cl.
CPC ..... *F04B 27/0886* (2013.01)

(58) Field of Classification Search
CPC .... F01B 3/0073; F01B 3/0088; F04B 1/126; F04B 27/0886
USPC ..... 92/71, 153; 91/505
See application file for complete search history.

(56) References Cited

U.S. PATENT DOCUMENTS

| | | | | | |
|---|---|---|---|---|---|
| 2,022,917 | A | * | 12/1935 | Larkin et al. | 384/42 |
| 2,250,607 | A | * | 7/1941 | Sherman | 384/2 |
| RE23,993 | E | * | 5/1955 | Henrichsen | 91/488 |
| 4,617,856 | A | * | 10/1986 | Miller et al. | 92/71 |
| 4,641,570 | A | * | 2/1987 | Futamura et al. | 92/71 |
| 4,683,803 | A | * | 8/1987 | Miller et al. | 92/71 |
| 5,782,161 | A | * | 7/1998 | Okubo et al. | 92/71 |
| 5,896,803 | A | * | 4/1999 | Sugawara et al. | 92/12.2 |
| 5,950,521 | A | * | 9/1999 | Fukushima et al. | 92/71 |
| 5,983,776 | A | * | 11/1999 | Hansell | 92/12.2 |

(Continued)

FOREIGN PATENT DOCUMENTS

| | | |
|---|---|---|
| DE | 10 2006 008 437 A1 | 10/2007 |
| JP | 57-76281 | 5/1982 |

(Continued)

OTHER PUBLICATIONS

JP2001-003858—Full machine translation of the applicant submitted prior art.*

(Continued)

*Primary Examiner* — Michael Leslie
*Assistant Examiner* — Michael Quandt
(74) *Attorney, Agent, or Firm* — Flynn, Thiel, Boutell & Tanis, P.C.

(57) ABSTRACT

A shoe 5 includes a spherical portion 5A in sliding contact with a sliding surface 4*a* that is a hemispherical concave portion of a piston 4, an end surface portion 5B in sliding contact with a swash plate 3, and a circular cylindrical portion 5C formed between the spherical portion 5A and the end surface portion 5B. Linear oil grooves 5F are formed in the outer peripheral surface of the cylindrical portion 5C.

10 Claims, 8 Drawing Sheets

(56) References Cited

U.S. PATENT DOCUMENTS

| | | | | |
|---|---|---|---|---|
| 6,477,938 | B1 * | 11/2002 | Nakayama et al. | 92/71 |
| 6,555,777 | B1 * | 4/2003 | Stoppek | 219/117.1 |
| 6,895,855 | B2 * | 5/2005 | Doll | 92/72 |
| 7,313,997 | B2 * | 1/2008 | Bin et al. | 92/71 |
| 7,455,008 | B2 * | 11/2008 | Kurita et al. | 92/12.2 |

FOREIGN PATENT DOCUMENTS

| | | | |
|---|---|---|---|
| JP | 9-280166 | | 10/1997 |
| JP | 10-220347 | | 8/1998 |
| JP | 11-22640 | | 1/1999 |
| JP | 11-50959 | | 2/1999 |
| JP | 11-050959 | | 2/1999 |
| JP | 2001-3858 | | 1/2001 |
| JP | 2001-153039 | | 6/2001 |
| JP | 2006-266141 | | 10/2006 |
| JP | 2008138545 A | * | 6/2008 |
| KR | 1020050051626 | * | 7/2007 |

OTHER PUBLICATIONS

JP11-050959—Full machine translation of the applicant submitted prior art.*

Application No. KR1020050051626, patent document No. KR100679863—English abstract translation.*

KR 100679863—Machine translation from Korean to English of Claims and description from KIPRIS. 2007.*

JP2008138545A English machine translation from JPO. 2008.*

Form PCT/ISA/210 dated Feb. 16, 2010 (3 pages).

Form PCT/ISA/220 dated Feb. 16, 2010 (4 pages).

Form PCT/ISA/237 dated Feb. 16, 2010 (4 pages).

Korean Office Action dated Apr. 24, 2012, with English translation of main section thereof.

European Search Report dated Jun. 24, 2011.

English translation of an Office Action of the European Patent Office issued in Application No. 09 843 177.8 dated Nov. 30, 2015 (4 pages).

* cited by examiner

SHOE

TECHNICAL FIELD

The present invention relates to a shoe, and more particularly, to an improvement in a shoe used for a swash plate compressor.

BACKGROUND ART

Hemispherical shoes used for swash plate compressors have been conventionally known. The hemispherical shoe includes a spherical portion in sliding contact with a hemispherical concave portion on a piston side, and an end surface portion in sliding contact with a swash plate (for example, Patent Literatures 1 to 4).

Recently, there has been a need for swash plate compressors for automobiles to be reduced in cost, be compatible with a new refrigerant, or the like. The swash plate compressors are particularly required to be more efficient.

To this end, the following improvements in the shoe have been proposed respectively in Patent Literatures 1 to 4. That is, in Patent Literature 1, the surface roughness of a sliding portion and the surface roughness of a non-sliding portion in the spherical portion of the hemispherical shoe are made different from each other. Patent Literature 2 proposes that the spherical portion has a stepped tapered surface. Also, Patent Literature 3 proposes that the outer peripheral edge of the hemispherical shoe is largely removed over the entire circumference to thereby form a cylindrical portion. Furthermore, Patent Literature 4 proposes that an oil groove having a spiral shape or the like is formed in the spherical portion of the hemispherical shoe.

PRIOR ART LITERATURE(S)

Patent Literature(s)

Patent Literature 1: Japanese Patent Laid-Open No. 2001-153039

Patent Literature 2: Japanese Patent Laid-Open No. 09-280166

Patent Literature 3: Japanese Patent Laid-Open No. 10-220347

Patent Literature 4: Japanese Patent Laid-Open No. 11-050959

SUMMARY OF INVENTION

Technical Problem

In the swash plate compressor, a lubricant oil is mixed in a refrigerant in a circulation circuit and is thereby also circulated, so that the lubricant oil is fed to the sliding portion between the shoe and each of the piston and the swash plate. However, the amount of lubricant oil enclosed within the refrigerant circulation circuit has been reduced in recent years. Thus, the sliding portion between the shoe and each of the piston and the swash plate suffers poor lubricant conditions.

Especially when the swash plate compressor is started, the lubricant oil is not mixed in the refrigerant in the circulation circuit. Thus, even when the refrigerant is circulated in the circulation circuit, the lubricant oil cannot be sufficiently fed to the sliding portion between the shoe and each of the piston and the swash plate through the refrigerant. Seizure thereby easily occurs in the sliding portion between the shoe and each of the piston and the swash plate in a conventional case when the swash plate compressor is started, so that such a problem is caused that abnormal sounds and noises are generated due to the abnormal wear of the sliding portion.

Solution to Problem

In view of the aforementioned circumstances, the present invention provides a shoe including a spherical portion in sliding contact with a hemispherical concave portion of a first movable member, an end surface portion in sliding contact with a flat surface of a second movable member, and a cylindrical portion formed between the spherical portion and the end surface portion, wherein a groove and/or a concave portion is provided in an outer peripheral surface of the cylindrical portion, and a lubricant oil is held in the groove and/or the concave portion.

Advantageous Effects of Invention

With the above configuration, in a case where the shoe is used for a swash plate compressor, a lubricant oil separated from a refrigerant is held in the oil groove or the concave portion of the shoe when the swash plate compressor is not started. Therefore, even when the lubricant oil is not mixed in the refrigerant at the time of starting the swash plate compressor, the lubricant oil held in the oil groove or the concave portion is fed to the spherical portion and the end surface portion of the shoe, which are the sliding portions. Accordingly, a shoe having a good lubricity, even when the swash plate compressor is started, can be provided.

DESCRIPTION OF EMBODIMENTS

Figure 1:
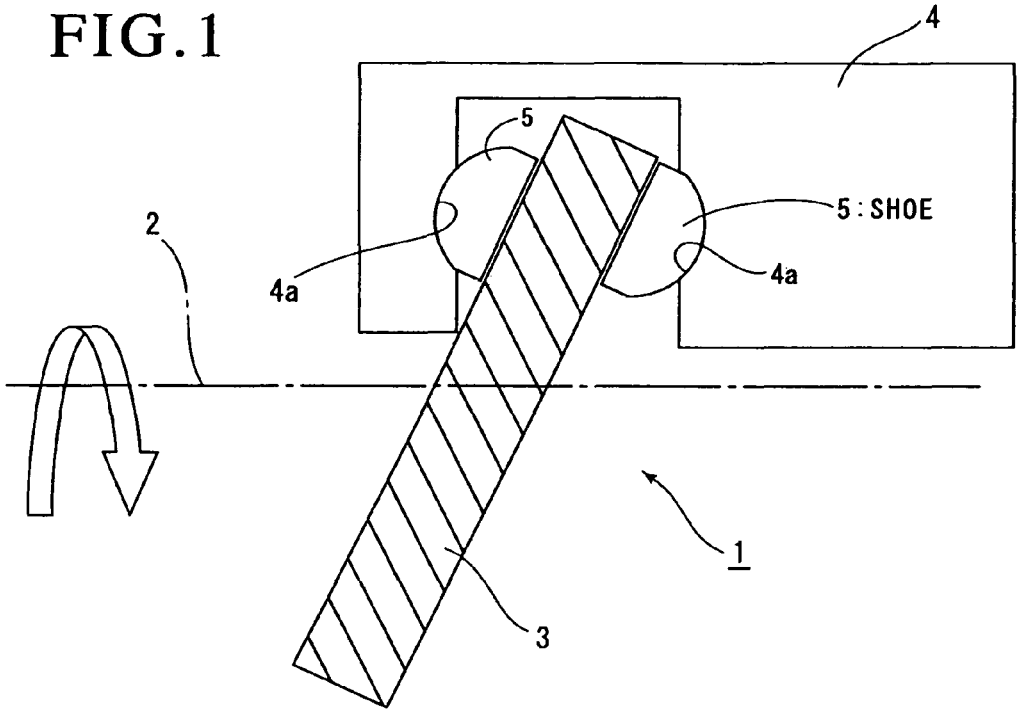
FIG. 1 is a sectional view illustrating a main portion in a swash plate compressor according to an embodiment of the present invention.

In the following, the present invention will be described based on embodiments shown in the drawings. FIG. 1 shows the internal structure of a swash plate compressor 1. The swash plate compressor 1 includes a rotating shaft 2 pivotally supported on an unillustrated housing in a rotatable manner, a swash plate 3 mounted on the rotating shaft 2, a plurality of pistons 4 reciprocating within an unillustrated cylinder bore of the housing, and a plurality of shoes 5 disposed so as to face each other inside each of the pistons 4 and holding the swash plate 3.

The swash plate 3 is obliquely fixed to the rotating shaft 2, or the inclination angle of the swash plate 3 can be changed. The swash plate 3 is held by the two shoes 5 in each of the pistons 4. A predetermined coating such as a thermally sprayed layer, a plated layer, and a resin coating is applied on the flat surfaces of the swash plate 3 in sliding contact with the shoes 5. Note that the configuration of the swash plate 3 applicable to the present invention is not limited to that described above, and various conventionally known swash plates can be used.

Sliding surfaces 4*a* having hemispherical concave portions are formed so as to face each other in the piston 4. The shoes 5 convert the rotation of the swash plate 3 into the reciprocating motion of the piston 4 while swinging and sliding on the sliding surfaces 4*a*.

The configuration of the swash plate compressor 1 as described above has been conventionally well known, and a further detailed description is omitted.

Figure 2:
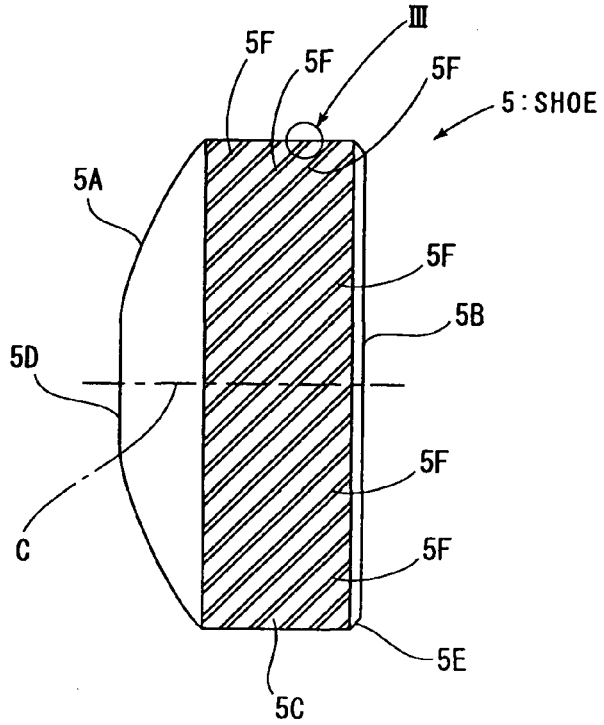
FIG. 2 is an elevation view of a shoe shown in FIG. 1.

The shoe 5 according to a present embodiment includes a spherical portion 5A in sliding contact with the sliding surface 4*a* of the piston 4, an end surface portion 5B in sliding contact with the flat surface of the swash plate 3, and a circular cylindrical portion 5C formed between the spherical portion 5A and the end surface portion 5B as shown in FIG. 2. The shoe 5 according to the present embodiment may be produced from a sintered material, a resin material or the like in addition to iron, copper, and aluminum materials.

A releasing portion 5D having a flat surface so as not to contact the sliding surface 4*a* on the piston 4 side is formed on the top of the spherical portion 5A. A lubricant oil is thereby allowed to flow into a space formed between the sliding surface 4*a* and the releasing portion 5D.

The end surface portion 5B defines a sliding surface in sliding contact with the swash plate 3, and has a crowned shape that slightly bulges about several μm at its center portion toward the swash plate 3 from the outer peripheral portion. The lubricant oil is thereby easily drawn into a space between the end surface portion 5B and the swash plate 3. A chamfered portion 5E is formed on the outer peripheral edge of the end surface portion 5B.

Next, the cylindrical portion 5C of the shoe 5 has a circular cylindrical shape with a constant outer diameter over the entire axial length. The axial length of the cylindrical portion 5C is set to be about twice as large as the axial length of the spherical portion 5A. The outer peripheral surface of the circular cylindrical portion 5C is not in sliding contact with the swash plate 3 and the sliding surface 4*a* of the piston 4. In the present embodiment, a plurality of linear oil grooves 5F are formed in the outer peripheral surface of the cylindrical portion 5.

The oil grooves 5F are circumferentially formed in the outer peripheral surface of the cylindrical portion 5C at equal pitches so as to be inclined 45 degrees to an axis C of the shoe 5. One end of each of the oil grooves 5F reaches the spherical portion 5A, and the other end of each of the oil grooves 5F reaches the chamfered portion 5E, that is, the outer peripheral edge of the end surface portion 5B.

Figure 3:
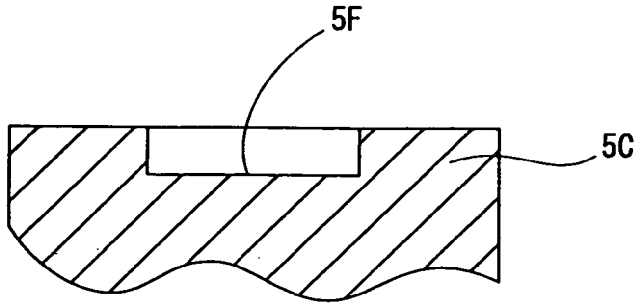
FIG. 3 is a sectional view of a portion indicated by an arrow III in FIG. 2 taken along an axial direction.

The sectional shape of the oil groove 5F is a horizontally long rectangle which has a constant depth and has a larger width than the depth as shown in FIG. 3. The width of the oil groove 5F is preferably 0.01 to 2 mm, and the depth of the oil groove 5F is preferably 0.001 to 1 mm.

As described above, the plurality of oil grooves 5F are formed in the outer peripheral surface of the cylindrical portion 5C from the end surface portion 5B to the spherical portion 5A in the shoe 5 according to the present embodiment. In the present embodiment, the oil grooves 5F are formed in the outer peripheral surface of the cylindrical portion 5C by knurling, turning, etching or the like.

With the shoe 5 according to the present embodiment, the retention of the lubricant oil is improved in comparison with the conventional shoe described above, so that better lubricity is obtained.

Figure 4:
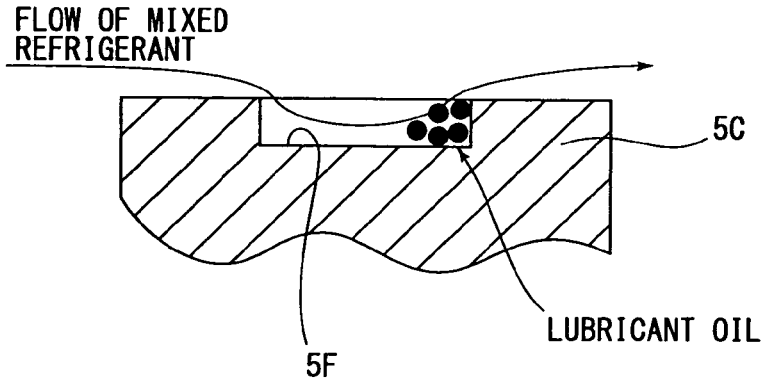
FIG. 4 is a schematic view illustrating the flow of a refrigerant with respect to an oil groove 5F shown in FIG. 3 and the state of a lubricant oil captured in the oil groove 5F.
Figure 5:
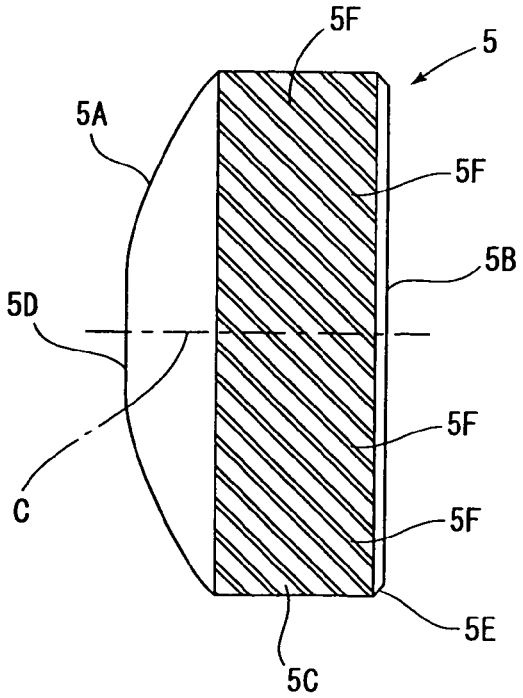
FIG. 5 is an elevation view of a shoe illustrating another embodiment of the present invention.

The operation will be described in detail. When a refrigerant including the lubricant oil axially flows around the outer peripheral surface of the cylindrical portion 5C, the lubricant oil included in the refrigerant enters each of the oil grooves 5F of the cylindrical portion 5C, and is captured therein to be easily separated from the refrigerant as shown in FIG. 4.

Therefore, when the swash plate compressor 1 is not started, that is, when the refrigerant is not circulated in a circulation circuit, the lubricant oil separated from the refrigerant is held in each of the oil grooves 5F. When the swash plate compressor 1 is started, the lubricant oil is not mixed in the refrigerant. However, since the lubricant oil is held in each of the oil grooves 5F of the shoe 5 in advance, the lubricant oil is fed from each of the oil grooves 5F to the spherical portion 5A and the end surface portion 5B, which are sliding portions, when the shoe 5 slides. In other words, the lubricant oil held in the plurality of oil grooves 5F is fed to the spherical portion 5A and the end surface portion 5B, which are the sliding portions, when the swash plate compressor 1 is started, so that the shoe 5 having good lubricity can be provided. Furthermore, since the cylindrical portion 5C is formed in the shoe 5 of the present embodiment, the shoe 5 itself is reduced in weight in comparison with the conventional hemispherical shoe.

Therefore, by using the shoe 5 of the present embodiment, a swash plate compressor 1 capable of suppressing the occurrence of seizure and abnormal sounds in the sliding portion between the shoe 5 and each of the swash plate 3 and the sliding surface 4*a*, and having a high durability and efficiency can be provided.

Next, FIGS. 5 to 9 show other embodiments to which the present invention is applied. In the embodiments, the orientation and shape of the oil grooves 5F are changed. That is, in the shoe 5 shown in FIG. 5, oil grooves 5F are formed inclined 45 degrees to the axis C such that the inclination direction thereof is opposite to that of the aforementioned first embodiment.

Figure 6:
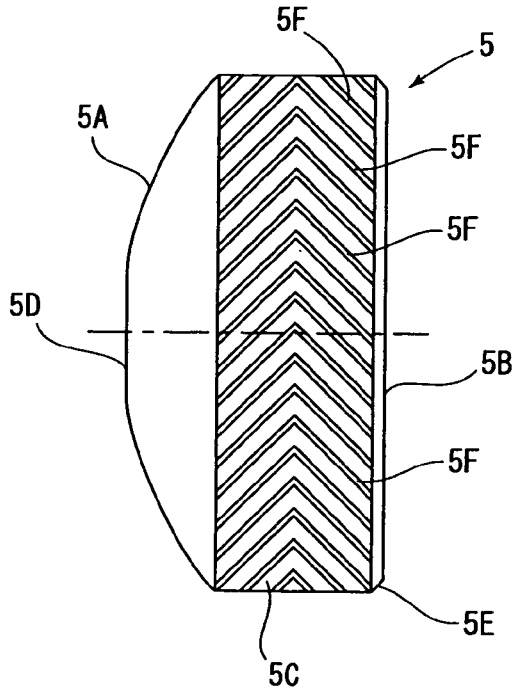
FIG. 6 is an elevation view of a shoe illustrating another embodiment of the present invention.

Next, in FIG. 6, V-shaped oil grooves 5F are circumferentially formed at equal pitches in the outer peripheral surface of the cylindrical portion 5C. One end of each of the V-shaped oil grooves 5F reaches the spherical portion 5A, and the other end of each of the oil grooves 5F reaches the chamfered portion 5E (the outer peripheral edge of the end surface portion 5B).

Figure 7:
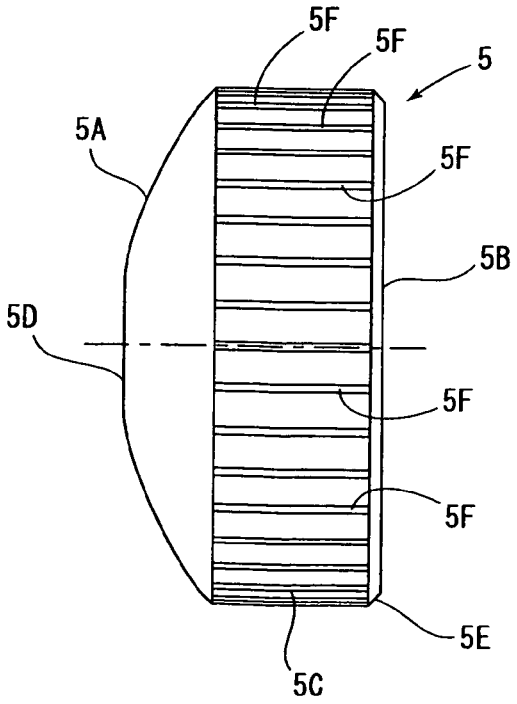
FIG. 7 is an elevation view of a shoe illustrating another embodiment of the present invention.

Next, in FIG. 7, linear oil grooves 5F are formed parallel to the axial direction at equal pitches in the outer peripheral surface of the cylindrical portion 5C. One end of each of the oil grooves 5F reaches the spherical portion 5A, and the other end reaches the chamfered portion 5E (the outer peripheral edge of the end surface portion 5B).

Figure 8:
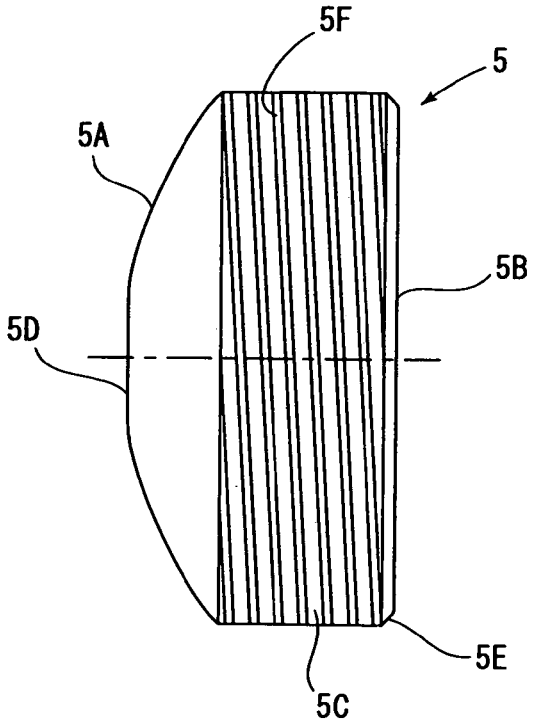
FIG. 8 is an elevation view of a shoe illustrating another embodiment of the present invention.

Next, in FIG. 8, a spiral oil groove 5F is formed in the outer peripheral surface of the cylindrical portion 5C. One end of the oil groove 5F reaches the spherical portion 5A, and the other end reaches the chamfered portion 5E (the outer peripheral edge of the end surface portion 5B).

The shoe 5 in each of the embodiments shown in FIGS. 5 to 8 described above is configured such that the spherical portion 5A and the end surface portion 5B, which are the sliding portions, are in communication with each other through the oil groove 5F. That is, when the shoe 5 is moved, the lubricant oil held in the oil groove 5F is fed to the spherical portion 5A and the end surface portion 5B as in the first embodiment shown in FIG. 2.

Although one end of the oil groove 5F reaches the spherical portion 5A and the other end of the oil groove 5F reaches the end surface portion 5B in the shoe 5 in each of the embodiments shown in FIGS. 2 to 8, the other end of the oil groove 5F may not reach the end surface portion 5B. That is, in this case, only the one end of the oil groove 5F reaches the spherical portion 5A.

Figure 9:
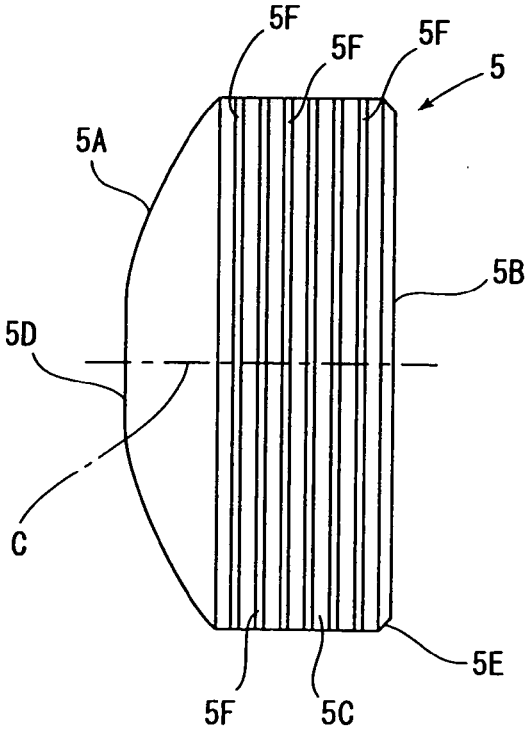
FIG. 9 is an elevation view of a shoe illustrating another embodiment of the present invention.

Furthermore, in the shoe 5 in the embodiment shown in FIG. 9, ring-shaped oil grooves 5F are formed perpendicular to the axis C at equal pitches in the outer peripheral surface of the cylindrical portion 5C. In each of the embodiments shown in FIGS. 5 to 9, the sectional shape of the oil groove 5F is the same rectangular sectional shape as that of the aforementioned first embodiment.

The same operation and effect as those of the first embodiment in FIG. 2 can be also obtained in each of the embodiments shown in FIGS. 5 to 9.

Figure 10:
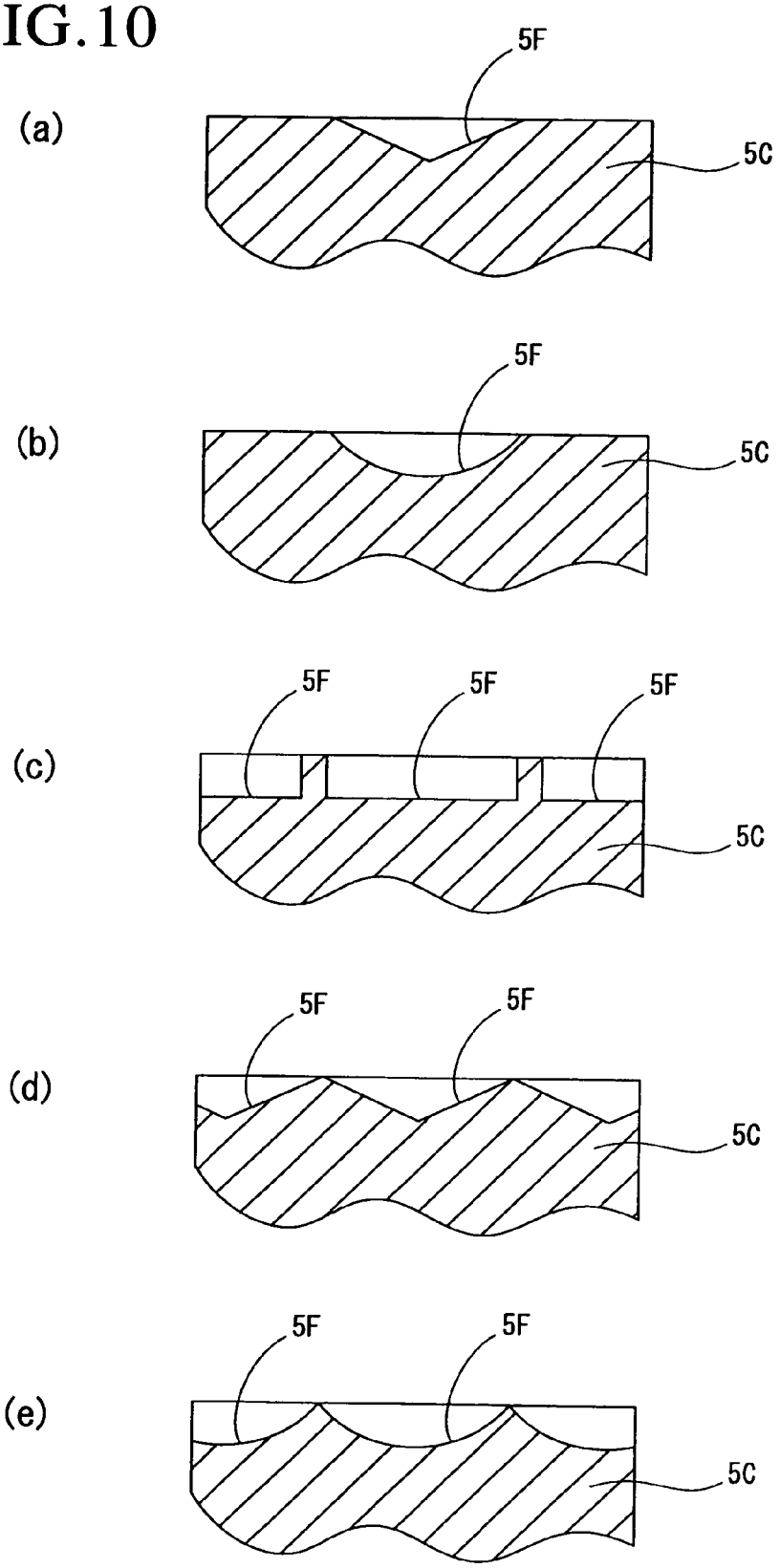
FIG. 10 are sectional views illustrating other embodiments regarding the oil groove shown in FIGS. 2 and 5 to 9.

The sectional shape and arrangement density of the oil grooves 5F in each of the aforementioned embodiments may be changed as shown in FIG. 10. That is, in FIG. 10(*a*), the sectional shape of the oil groove 5F is a triangular shape, and in FIG. 10(*b*), the sectional shape of the oil groove 5F is an arc shape. Furthermore, FIGS. 10(*c*) to 10(*e*) show embodiments in which the adjacent oil grooves 5F are arranged as close as possible to each other.

Figure 11:
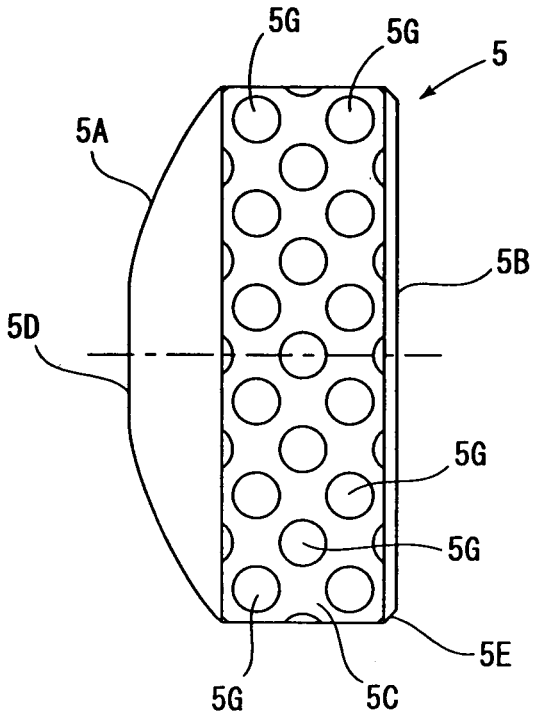
FIG. 11 is an elevation view of a shoe illustrating another embodiment of the present invention.
Figure 12:
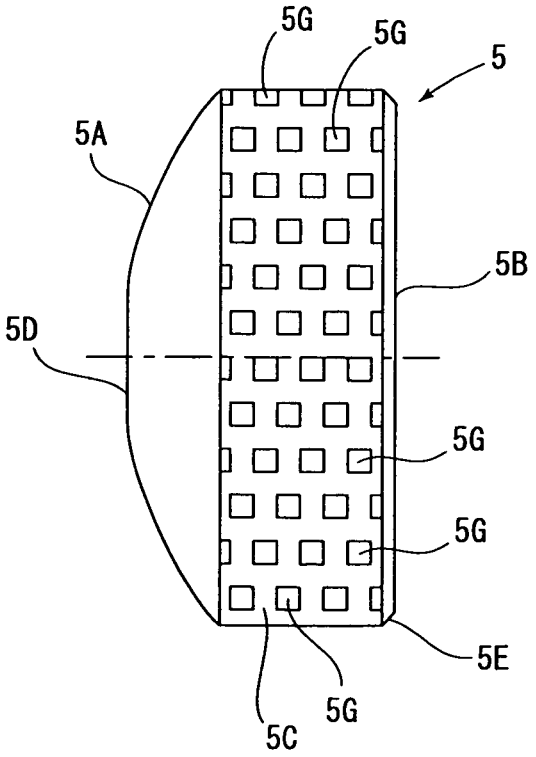
FIG. 12 is an elevation view of a shoe illustrating another embodiment of the present invention.

Next, FIGS. 11 and 12 show yet other embodiments according to the present invention. In the embodiments, a plurality of concave portions 5G are formed in the outer peripheral surface of the cylindrical portion 5C instead of the oil grooves 5F. To be more specific, in FIG. 11, circular concave portions 5G having the same dimensions as each other are formed in a staggered manner in the outer peripheral surface of the cylindrical portion 5C.

Also, in FIG. 12, square concave portions 5G having the same dimensions as each other are formed in the outer peripheral surface of the cylindrical portion 5C. A plurality of triangular or oval concave portions may be also formed in the outer peripheral surface of the cylindrical portion 5C instead of the circular and square concave portions 5G.

The shoe 5 where the plurality of concave portions 5G are formed in the outer peripheral surface of the cylindrical portion 5C can also produce the same operation and effect as those of the aforementioned first embodiment.

Figure 13:
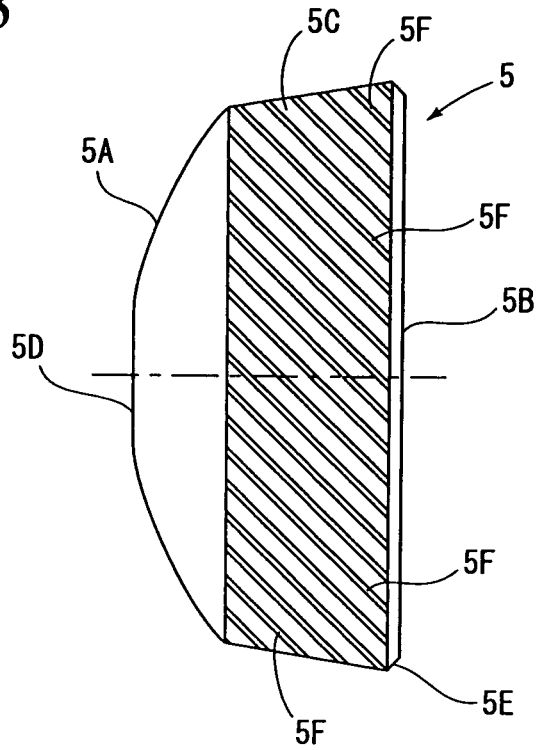
FIG. 13 is an elevation view of a shoe illustrating another embodiment of the present invention.
Figure 14:
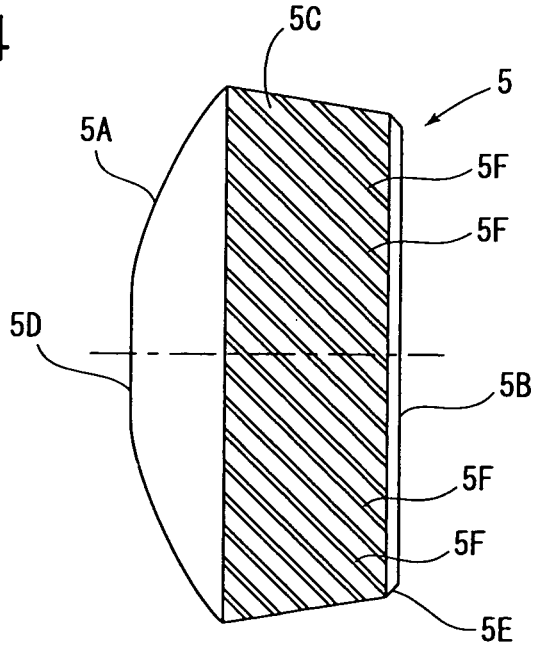
FIG. 14 is an elevation view of a shoe illustrating another embodiment of the present invention.
Figure 15:
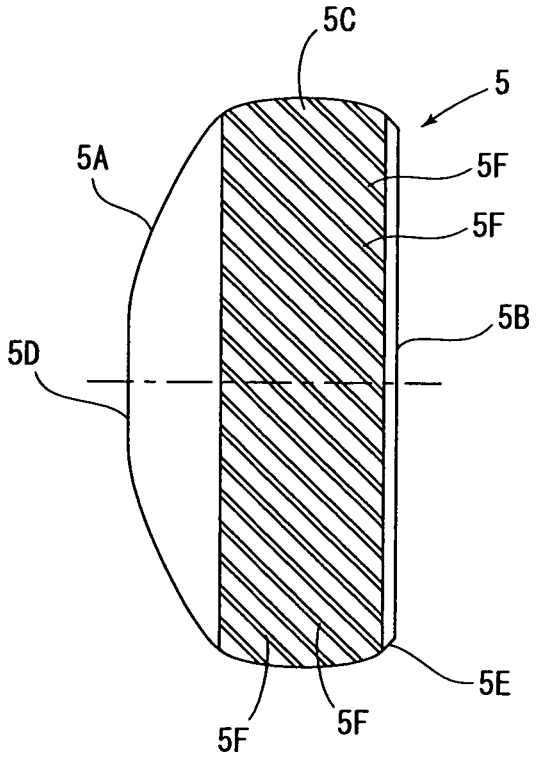
FIG. 15 is an elevation view of a shoe illustrating another embodiment of the present invention.

Next, FIGS. 13 to 15 show yet other embodiments according to the present invention. In the embodiments, the shape of the cylindrical portion 5C is changed.

To be more specific, in FIG. 13, the cylindrical portion 5C of the shoe 5 is formed in a tapered shape which is gradually reduced in diameter from the end surface portion 5B toward the spherical portion 5A. The plurality of oil grooves 5F similar to those of the first embodiment in FIG. 2 are formed in the outer peripheral surface of the cylindrical portion 5C having such a tapered shape.

Also, in FIG. 14, the cylindrical portion 5C of the shoe 5 is formed in a tapered shape which is gradually reduced in diameter from the spherical portion 5A toward the end surface portion 5B. The linear oil grooves 5F are formed in the outer peripheral surface of the cylindrical portion 5C having such a tapered shape.

Moreover, in FIG. 15, the cylindrical portion 5C has a drum shape whose axial center portion expands outward in the radial direction so as to have a largest outer diameter, and the plurality of linear oil grooves 5F are formed in the outer peripheral surface.

The shoe 5 in each of the embodiments shown in FIGS. 13 to 15 can also produce the same operation and effect as those of the aforementioned first embodiment. In the embodiments of FIGS. 13 to 15, the plurality of concave portions 5G shown in FIGS. 11 and 12 may be also formed in the outer peripheral surface of the cylindrical portion 5C instead of the oil grooves 5F.

Although one end of the oil groove 5F reaches the spherical portion 5A and the other end of the oil groove 5F reaches the end surface portion 5B in the shoe 5 in each of the embodiments shown in FIGS. 13 to 15, the other end of the oil groove 5F may not reach the end surface portion 5B. That is, in this case, only the one end of the oil groove 5F reaches the spherical portion 5A.

Figure 16:
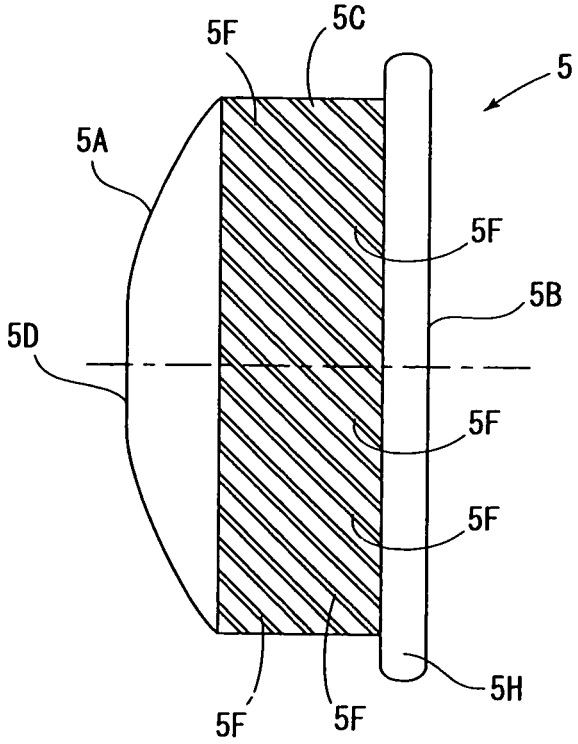
FIG. 16 is an elevation view of a shoe illustrating another embodiment of the present invention.

FIG. 16 further shows yet another embodiment according to the present invention. In the embodiment, a flange portion 5H is formed projecting on the outer peripheral edge of the end surface portion 5B of the first embodiment shown in FIG. 2. Based on the configuration, the linear oil grooves 5F are formed in the outer peripheral surface of the cylindrical portion 5C of the shoe 5 in a similar manner to the aforementioned first embodiment. The other components in the configuration are the same as those of the first embodiment. The shoe 5 shown in FIG. 16 can also produce the same operation and effect as those of the aforementioned respective embodiments.

The flange portion 5H may be also provided projecting on the outer peripheral edge of the end surface portion 5B in the shoe 5 according to the embodiment shown in each of FIGS. 2 to 9 and 11 to 15 in a similar manner to FIG. 16.

Furthermore, grid-like oil grooves may be also provided in the outer peripheral surface of the cylindrical portion 5C instead of the linear oil grooves 5F in each of the aforementioned embodiments. Alternatively, both the oil grooves 5F and the concave portions 5G may be provided in the outer peripheral surface of the cylindrical portion 5C.

REFERENCE SIGNS LIST

3: Swash plate (Second movable member)
4: Piston (First movable member)
4*a*: Sliding surface
5: Shoe
5A: Spherical portion
5B: End surface portion
5C: Cylindrical portion 5F: Oil groove 5G: Concave portion

The invention claimed is:

1. A shoe comprising:

a spherical portion having a spherical surface that slides in a hemispherical concave portion of a first movable member, with neither a groove nor a concave portion being formed on the spherical surface;

an end surface portion having a sliding surface that slides on a flat surface of a second movable member;

a cylindrical portion formed between the spherical portion and the end surface portion, the cylindrical portion being unitary with the spherical portion and the end surface portion; and a plurality of grooves formed on an outer peripheral surface of the cylindrical portion for holding a lubricant oil, the grooves having a constant depth, a rectangular sectional shape and extending continuously from the spherical portion to the end surface portion, wherein the cylindrical portion does not slide in either the hemispherical concave portion of the first movable member or on the flat surface of the second movable member.

2. The shoe according to claim 1, wherein the cylindrical portion has a constant outer diameter over an entire axial length.

3. The shoe according to claim 1, wherein the cylindrical portion is formed in a tapered shape where the spherical portion side has a smaller diameter than the end surface portion side.

4. The shoe according to claim 1, wherein the cylindrical portion is formed in a tapered shape where the end surface portion side has a smaller diameter than the spherical portion side.

5. The shoe according to claim 1, wherein the cylindrical portion has a drum shape where an axial center portion radially expands outward so as to have a largest outer diameter.

6. The shoe according to claim 1, further comprising a flange portion formed radially extending outward on an outer peripheral edge of the end surface portion, the flange portion being unitary with the spherical portion, the end surface portion, and the cylindrical portion.

7. The shoe according to claim 1, wherein the plurality of grooves have a linear or V shape, and are provided at equal pitches in the outer peripheral surface of the cylindrical portion.

8. The shoe according to claim 1, wherein the plurality of grooves are provided at equal pitches in the outer peripheral surface of the cylindrical portion.

9. The shoe according to claim 1, wherein the cylindrical portion is longer than the spherical portion.

10. The shoe according to claim 1, wherein the end surface portion has neither a groove nor a concave portion on an outer peripheral surface of the end surface portion.

* * * * *